US011974713B2

(12) United States Patent
Hagleitner

(10) Patent No.: US 11,974,713 B2
(45) Date of Patent: May 7, 2024

(54) DISPENSER FOR DISCHARGING A CHEMICAL AGENT FROM A CONTAINER COUPLED TO THE DISPENSER

(71) Applicant: Hans Georg Hagleitner, Zell am See (AT)

(72) Inventor: Hans Georg Hagleitner, Zell am See (AT)

( * ) Notice: Subject to any disclaimer, the term of this patent is extended or adjusted under 35 U.S.C. 154(b) by 894 days.

(21) Appl. No.: 16/767,308

(22) PCT Filed: Jan. 8, 2019

(86) PCT No.: PCT/EP2019/050330
§ 371 (c)(1),
(2) Date: Sep. 24, 2020

(87) PCT Pub. No.: WO2019/149479
PCT Pub. Date: Aug. 8, 2019

(65) Prior Publication Data

US 2021/0106204 A1 Apr. 15, 2021

(30) Foreign Application Priority Data

Jan. 30, 2018 (EP) ..... 18154080

(51) Int. Cl.
*A47L 15/44* (2006.01)
*D06F 34/04* (2020.01)
(Continued)

(52) U.S. Cl.
CPC ..... *A47L 15/4454* (2013.01); *A47L 15/4463* (2013.01); *D06F 34/04* (2020.02);
(Continued)

(58) Field of Classification Search
CPC ..... A47L 15/4454; A47L 15/4463; A47L 2401/02; D06F 34/04; D06F 34/05;
(Continued)

(56) References Cited

U.S. PATENT DOCUMENTS 4,020,865 A * 5/1977 Moffat ..... D06F 39/02 137/268
2007/0044820 A1* 3/2007 Chan ..... B67D 7/346 134/18

(Continued)

FOREIGN PATENT DOCUMENTS

DE 102007014425 9/2008
WO WO2010091782 8/2010

OTHER PUBLICATIONS

International Search Report issued in PCT/EP2019/050330 dated Feb. 12, 2019.

*Primary Examiner* — J C Jacyna
(74) *Attorney, Agent, or Firm* — Workman Nydegger

(57) ABSTRACT

The dispenser (1) is configured to couple with a container (100) containing at least one chemical agent (101) and to dispense the chemical agent (101) when the dispenser (1) has been coupled with the container (100). The container (100) may be introduced into a receiving space (5) of the dispenser (1) into a coupling position. The dispenser (1) has a sensor (7) for the contact-free detection of container information or container content information and an occupancy sensor (8), which detects whether a container (100) that has been inserted into the receiving space (5) is in the coupling position. Only when the container (100) is in the coupling position, then the occupancy sensor (8) will activate the sensor (7) for the contact-free detection of container information or container content information, which detects in the activated state the container information or container content information and examines the correctness thereof. If this is positive, the sensor (7) initiates a release of the dispenser (1) into an operational state, wherein the chemical agent (101) may be dispensed from the container (100).

20 Claims, 6 Drawing Sheets

(51) Int. Cl.

| | |
|---|---|
| ***D06F 39/02*** | (2006.01) |
| *D06F 34/05* | (2020.01) |
| *D06F 34/20* | (2020.01) |
| *D06F 103/22* | (2020.01) |
| *D06F 105/42* | (2020.01) |

(52) U.S. Cl.
CPC ..... *D06F 39/02* (2013.01); *A47L 2401/02* (2013.01); *D06F 34/05* (2020.02); *D06F 34/20* (2020.02); *D06F 2103/22* (2020.02); *D06F 2105/42* (2020.02)

(58) Field of Classification Search
CPC ..... D06F 34/14; D06F 34/20; D06F 39/02; D06F 2103/22; D06F 2105/42; D06F 2401/02
See application file for complete search history.

(56) References Cited

U.S. PATENT DOCUMENTS

| | | | | |
|---|---|---|---|---|
| 2010/0108105 | A1* | 5/2010 | Classen | A47L 15/4463 134/93 |
| 2011/0247663 | A1* | 10/2011 | Gadini | A47L 15/4454 222/173 |
| 2012/0031930 | A1* | 2/2012 | Fileccia | A47L 15/4472 222/129 |
| 2023/0240507 | A1* | 8/2023 | Gadini | F04B 43/12 222/71 |

* cited by examiner

DISPENSER FOR DISCHARGING A CHEMICAL AGENT FROM A CONTAINER COUPLED TO THE DISPENSER

The invention relates to a dispenser for coupling with a container containing at least one chemical agent and for dispensing the chemical agent when the dispenser is coupled with the container, according to the preamble of claim 1.

From WO 2010/091782 A1 there has been known a metering device that may be coupled with a cartridge for dispensing a wash or cleaning agent, respectively, contained in the cartridge, to a washing machine. The metering device comprises a control unit, an actuator coupled with a closure element and at least one sensor. The cartridge may have an RFID label that contains information on the content of the cartridge and that may be read by an RFID reader. This information is used in order to select a certain metering programme or in order to omit dosage in the case of a cartridge having a false or defect RFID label and instead generate an optical or acoustic error signal. The washing agent, in the operational position of the cartridge, will flow, due to gravity, through a bottom-side outlet opening out of the cartridge. This outlet opening may be coupled with an inlet opening of the metering device. The metering device and the cartridge have notch means for the mutual connection. In the locked state, the cartridge and the metering device may be mutually pivoted about a pivoting point. FIG. 27 shows the cartridge and the metering device in the uncoupled state; FIG. 28 shows the cartridge and the metering device in the pivotingly locked state. Upon locking of cartridge and metering device, by pivoting the cartridge, the outlet opening of the cartridge and the inlet opening of the metering device are moved into a coupling state, wherein they are connected in communication. There may be formed means at the cartridge and/or at the metering device, which cause, in the locked state of cartridge and metering device, which cause guiding of the cartridge upon pivoting into the coupling state of cartridge and metering device. In order to prevent any incorrect use of the cartridge, the cartridges may also have structural elements, which cooperate with corresponding elements of the metering device according to the key-lock-principle such that, for example, only cartridges of a particular type may be coupled to the metering device.

By providing the RFID label with information on the content of the cartridge, the metering device may basically recognize whether the correct cartridge has been inserted; the error signal provided in the case of false cartridges will prevent careless operators from inserting a false cartridge. Insertion of a false cartridge may be effectively prevented only by the provision of structural elements, which cooperate with corresponding elements of the metering device according to the key-lock-principle. This measure will prevent the insertion of a false cartridge, it will, however, not give any indication on whether a correct cartridge has been correctly inserted or not. Hence, there is the risk that the chemical agents contained in the cartridge may leak, without this being detected or effectively prevented. The provided pivoting process between cartridge and metering device for coupling the outlet of the cartridge with an inlet of the metering device represents a further risk for a leaking coupling between cartridge and metering device. Furthermore, the RFID reader is operating during the entire operating time of the metering device, thus wasting energy and processor resources of the control device.

There is, hence, a demand for a dispenser for dispensing at least one chemical agent from a container, wherein a leak-proof coupling between the container and the dispenser is being ensured, wherein this leak-proof coupling is maintained during the entire operating time of the dispenser. Retrieval of the chemical agent from the container should only be performed if there is being ensured that the container is correctly coupled with the dispenser. A further task is the reduction of energy consumption when a container type or the content thereof, respectively, are detected as well as the reduction of processor resources in a control device of the dispenser.

The present invention solves these tasks by providing a dispenser having the features of the claim 1. Further features and advantages of the invention arise from the sub-claims and the following description.

The dispenser according to the invention is configured for coupling with a container containing at least one chemical agent and for dispensing the chemical agent when the dispenser is coupled with the container. The dispenser comprises a container holder having a receiving space, into which the container may be introduced in part into a coupling position. The dispenser has a sensor configured for the contact-free detection of container information of container content information at or near the receiving space. The dispenser further has an occupancy sensor, which is configured to detect whether a container inserted into the receiving space is in the coupling position. The sensor for the contact-free detection of container information or container content information is configured to detect the container information or container content information and examine the correctness thereof. The dispenser is configured to be released into an operational state, wherein the chemical agent may be dispensed from the container when the occupancy sensor has detected a container inserted into the receiving space in the coupling position and when the sensor for the contact-free detection of container information or container content information has determined the correctness of the examined container information or container content information.

By scanning the position of the container by means of the occupancy sensor, which may, for example, also be embodied as a mechanically activated sensor, there is ensured that the dispenser cannot transit into an operational state as long as the container is not in the correct coupling position, as only upon detection of the correct coupling position the dispenser may be brought into the operational state for dispensing the chemical agent. As additional protective measures, the dispenser may also only be brought into the operational state for dispensing the chemical agent when the sensor for the contact-free detection of container information or container content information has determined the correctness of the detected container information or container content information. Hence, there is realized a two-step examination of the correct position of the container in the coupling position and presence of a container having the correct ingredient. This two-step examination is essential for a high reliability of the dispenser according to the invention, as scanning by the occupancy sensor will not ensure that the correct container has been inserted, and scanning by the sensor for the contact-free detection of container information or container content information cannot ensure that the container is positioned in the correct coupling position, as such sensors usually have a range of detection, which is not limited to the coupling position of a container.

In a useful and energy-saving embodiment of the invention the occupancy sensor is configured to activate, upon detection of a container inserted into the receiving space in the coupling position, the sensor for the contact-free detection of container information or container content information, wherein the sensor for the contact-free detection of container information or container content information, in the activated state, will detect the container information or container content information.

In an embodiment of the invention there is further provided that the sensor for the contact-free detection of container information or container content information initiates the release of the dispenser into the operational state, wherein the chemical agent may be dispensed from the container. This initiation may be realized directly or indirectly via controlling a control or an actuator.

If the container to be inserted into the dispenser carries container information or container content information in an RFID label attached to the container, then there is provided according to the invention that the sensor for the contact-free detection of container information or container content information is to be configured as an RFID reader.

If the container to be inserted into the dispenser carries container information or container content information in an optical form, for example in the form of a colour code, barcode or QR code, then there is provided according to the invention that the sensor for the contact-free detection of container information is to be configured as an optical sensor, e.g., as digital line or area image sensor.

In a preferred as easy to be configured but still rather reliable embodiment of the invention, the occupancy sensor is to be configured as a sensor for mechanically scanning a structural feature of the container, in particular a shoulder, a projection or an indentation of the container. The occupancy sensor is preferably configured as a lever, switch or spring.

According to the invention, the receiving space may be embodied as a compartment. This enables a linear movement of the container into the receiving space, whereby the container may be brought into a coupling position rather quickly and reliably, thus also providing a safe and secure support for the inserted container.

For the highest operational safety of the dispenser according to the invention there is provided that the container holder may be moved between a replacement position, wherein a container may be inserted and retrieved, and an operational position, wherein the chemical agent may be dispensed from an inserted dispenser. The movement motion may be a pivoting movement. There is to be stressed that the container is always moved together with the container holder and can thus not be removed from the coupling position, which is in contrast to prior art, wherein a cartridge is pivoted in regard to a metering device. There is further provided a locking device that is controlled by a sensor for the contact-free detection of container information and switchable between a locking position and a releasing position, which only allows for the movement of the container holder into the operational position when it has been switched into the releasing position by the sensor for the contact-free detection of container information. This measure will provide additional safety in regard to incorrect use or an inadvertent start of dispensing the chemical agent from the container.

The sensor for the contact-free detection of container information preferably has an actuator, preferably a solenoid, which is configured to switch the locking device between the locking position and the releasing position. The locking device may have at least one extractable latch, which in the locking position will lock the container holder securely in the replacement position.

In order to minimize energy consumption of the dispenser and of processor resources in the control of the dispenser, the invention also provides for the configuration of the occupancy sensor to deflect a switch, preferably a magnetic switch, into an activating position if the container is in the coupling position. In the activating position the switch activates the sensor for the contact-free detection of container information or container content information. The switch is further configured to be deflected from the activating position into a deactivating position, wherein the sensor for the contact-free detection of container information or container content information is deactivated if the container holder is moved from the replacement position into the operational position. Thereby, deflection of the switch, e.g., by guiding along a setting or a drive means or springs, may be accomplished.

In order to ensure that the container cannot inadvertently be removed from the dispenser, while the dispenser is in the operational position, there are provided slidable fixation elements according to the invention, which are configured to be slid, by moving the container holder from the replacement position into the operational position, into engagement with the container and which are configured to be moved, by moving the container holder from the operational position into the replacement position, into disengagement with the container.

In order to ensure a leak-proof coupling between the container and the dispenser, there is provided in one embodiment of the invention that there is arranged in the receiving space an inlet connection for connection with an outlet of the container, wherein the inlet connection has a ram that may be extracted into the outlet of the container and that may be retracted from the outlet of the container, wherein the ram is configured to extract upon movement of the container holder into the operational position, wherein the ram preferably extracts only immediately before reaching the operational position, in particular within the last 20% of the movement path of the container holder into the operational position, and is retracted upon movement of the container holder into the replacement position. In an embodiment of the invention that is very operationally safe and proof against leaking of the chemical agent, the ram is integrated in a tank for the temporary storage of the chemical agent and is moved together with the tank, which is configured to move towards and away from the inlet connection, thereby entraining the ram. In this way, in the case of the ram being extracted into the outlet of the container, the chemical agent will flow through the ram directly into the tank, from where it will be dispensed by a pump installed in the dispenser by way of gravity. In order to facilitate the operation of the dispenser, there may be provided at least one spring, which biases the container holder into the replacement position and the operational position.

The invention is now described in regard to the drawing by way of an exemplary embodiment.

Figure 1:
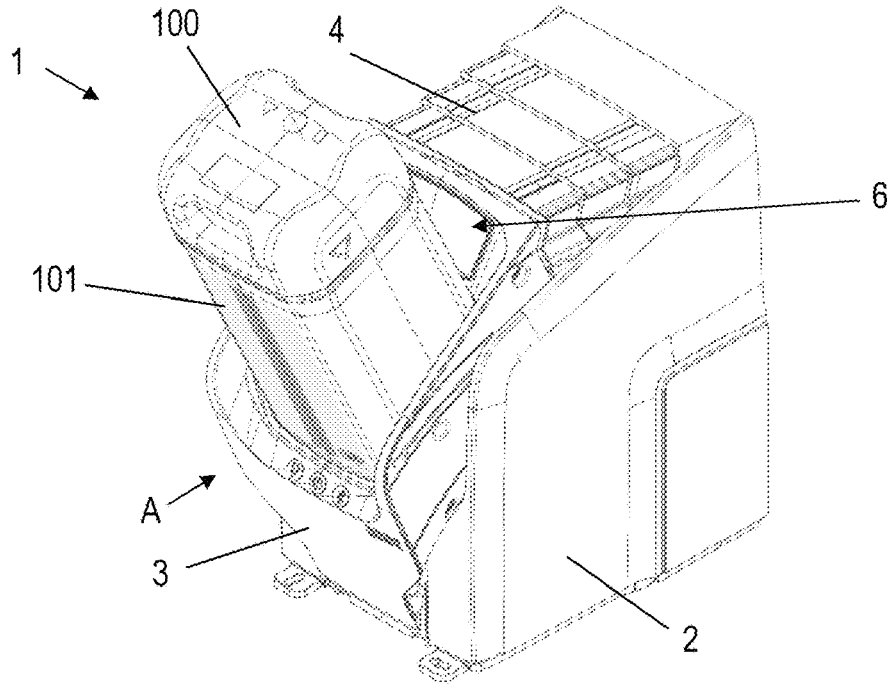
FIG. 1 shows the dispenser according to the invention, having the container inserted into a replacement position, in a perspective view.
Figure 2:
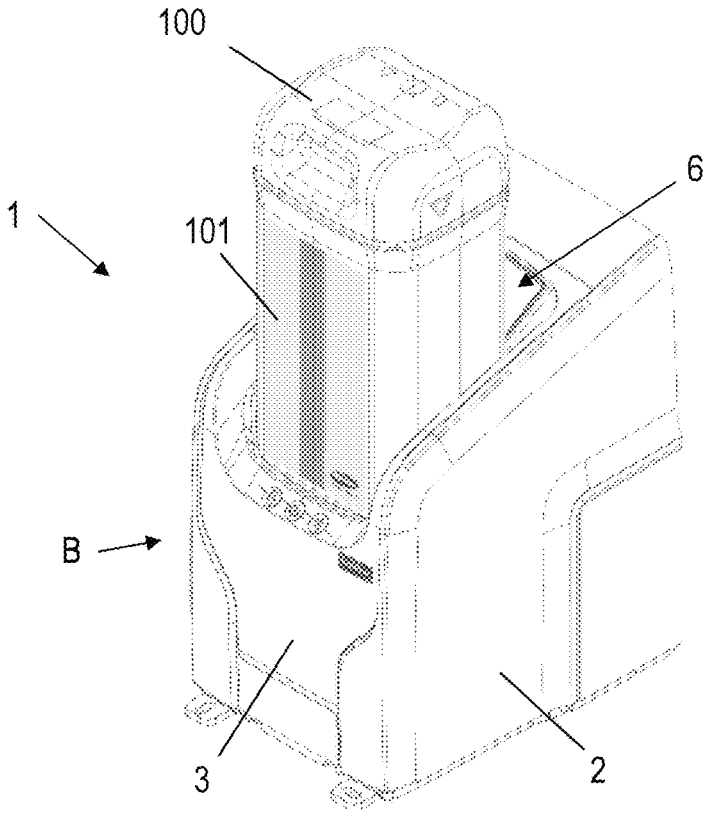
FIG. 2 shows the dispenser, having the container inserted into an operational position, in a perspective view.

Firstly, there is referred to FIG. 1 and FIG. 2, which present an embodiment of the dispenser 1 according to the invention in perspective views. The dispenser 1 has a device basis 2 that is suitable for the installation in ground or wall, in which a container holder 3 is arranged for receiving a container 100. The container 100 contains at least one flowable or pourable chemical agent 101, such as, e.g., a cleaning agent for dishes or clothes. In the FIGS. 1 and 2, the container 100 is shown coupled with the dispenser 1 via the container holder 3 and in the coupling position. The container holder 3 is arranged movable on the device base 2. More particularly, the container holder 3 may be moved along guidings that are not depicted between the inclined replacement position A that is shown in FIG. 1, wherein the container 100 may be inserted into the container holder 3 and retrieved therefrom, and a vertical operational position B, wherein the chemical agent 101 may be dispensed from the inserted container 100. The guidings are embodied such that the container holder 3 performs approximately a pivoting movement. Alternatively to the guidings, the container holder 3 could also be moved by means of a pivoting axis in the device base 2. A fan-shaped extractable and retractable covering 4 moves along with the container holder 3, covering the top side of the dispenser 1.

Figure 3:
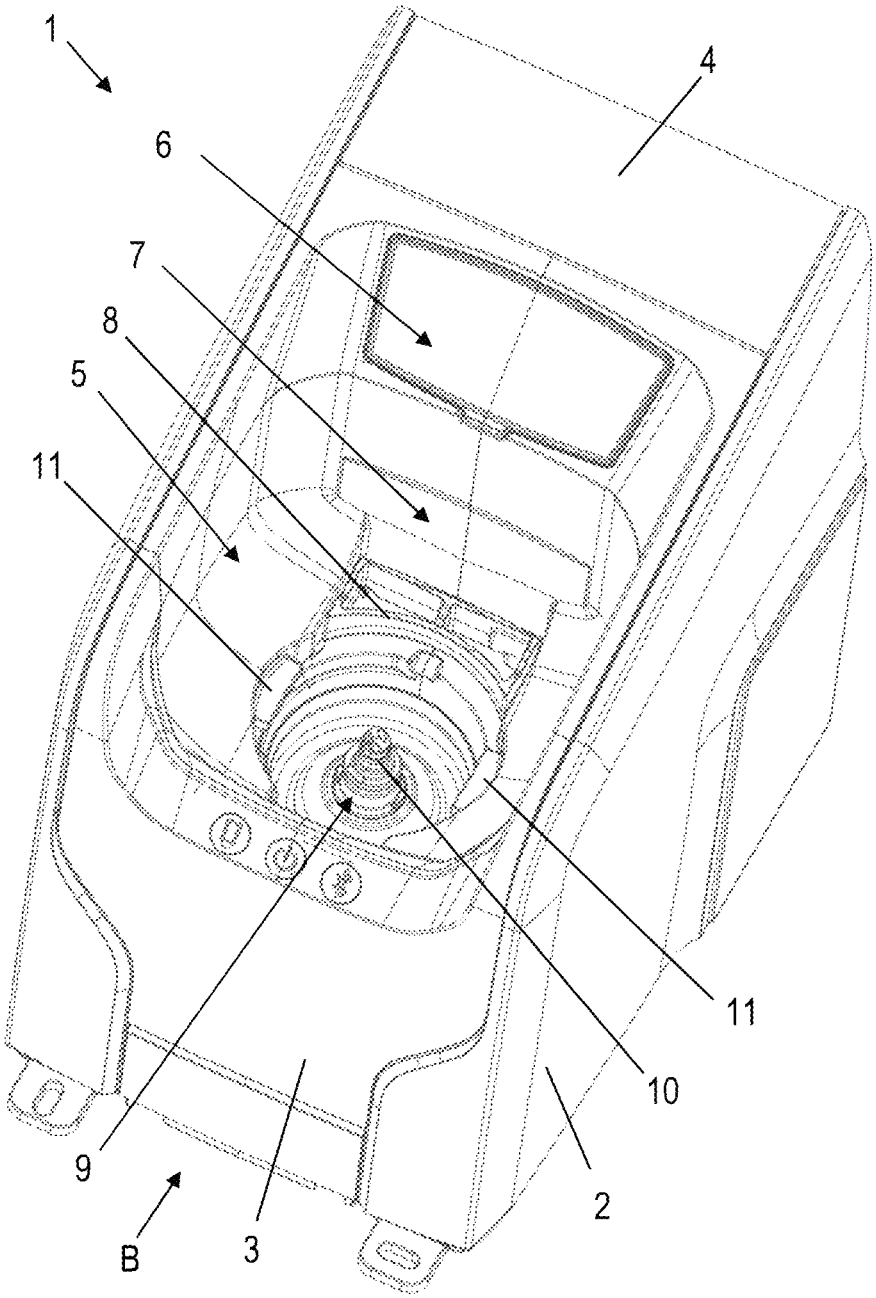
FIG. 3 shows the dispenser without container in the operational position in a perspective view.

FIG. 3 shows the dispenser 1 in the operational position B without the container 100. This view slanted from above reveals a receiving space 5 in the form of a compartment for the container 100. The side walls of the receiving space 5 guide the container 100 when being inserted into the coupling position and when being retrieved from the container holder 3, thus supporting it in the inserted state. In FIG. 3 there is schematically indicated, using an arrow, an electronic control, which is equipped with a microprocessor and controls the dispenser 1. The reference number 7 further designates a sensor for the contact-free detection of container information or container content information. The sensor 7 for the contact-free detection of container information or container content information may be an RFID reader, which is configured to read an RFID label containing the container information or container content information, which is attached at the container 100. Alternatively, the sensor 7 for the contact-free detection of container information may be an optical sensor, which is configured to detect optical information attached at the container 100, from which the container information or container content information may be deduced. The optical information may, for example, be attached in the form of a colour code, barcode or QR code at the container 100. The sensor 7 for the contact-free detection of container information is configured, e.g., as a digital line or area image sensor.

Figure 5:
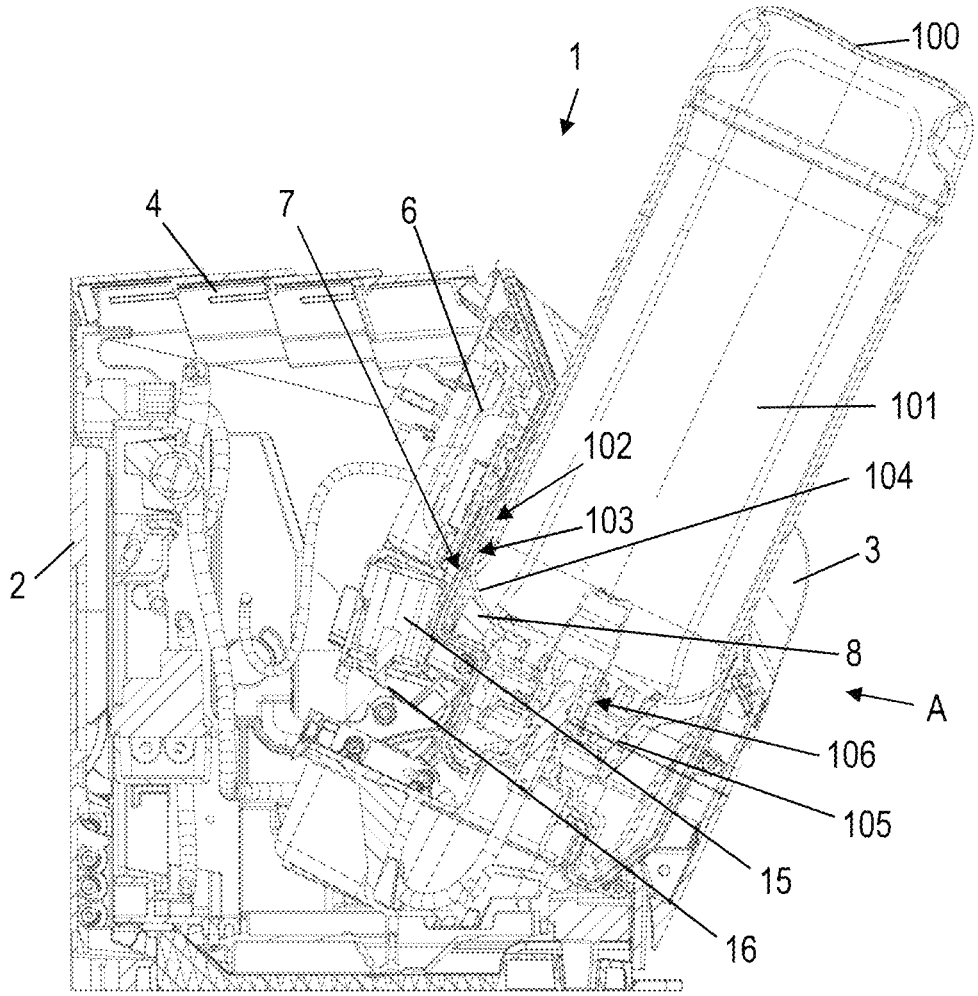
FIG. 5 shows a central longitudinal section through the dispenser.

In FIG. 3 there is further visible an occupancy sensor 8 arranged in the receiving space 5. This occupancy sensor 8 is configured to detect whether a container 100 inserted into the receiving space 5 is in the coupling position, by the occupancy sensor 8 mechanically scanning a structural feature 104 of the container 100 that is depicted in FIG. 5. In this exemplary embodiment, the occupancy sensor 8 scans a structural feature in the form of a shoulder of the container 100, by the occupancy sensor 8 being embodied as a lever only (and only then) contacting the container shoulder and being deflected thereby when the container 100 has reached the coupling position. The occupancy sensor 8 is embodied as a lever or spring in this exemplary embodiment, which switches a switch 14 upon deflection of the container 100, as is described in greater detail below in relation to FIG. 6. Alternatively, the occupancy sensor 8 may also be embodied as a switch that may be actuated by the container 100 itself. The switch switched by the occupancy sensor 8 activates the sensor 8 for the contact-free detection of container information or container content information. When the sensor 7 for the contact-free detection of container information or container content information is activated, it will detect the container information or container content information attached to the container 100 and examine the correctness of the container information of container content information, i.e. whether there may even be read a container information or container content information, and if yes, whether the values correspond to the expected container 100 or container content such as, e.g., the chemical agent 101. Only when the examination determines the correctness of the container information or container content information, then the sensor 7 for the contact-free detection of container information or container content information will initiate a release of the dispenser 1 into an operational state, wherein the chemical agent 101 may be dispensed from the container 100. This process will be explained in greater detail below.

Figure 4:
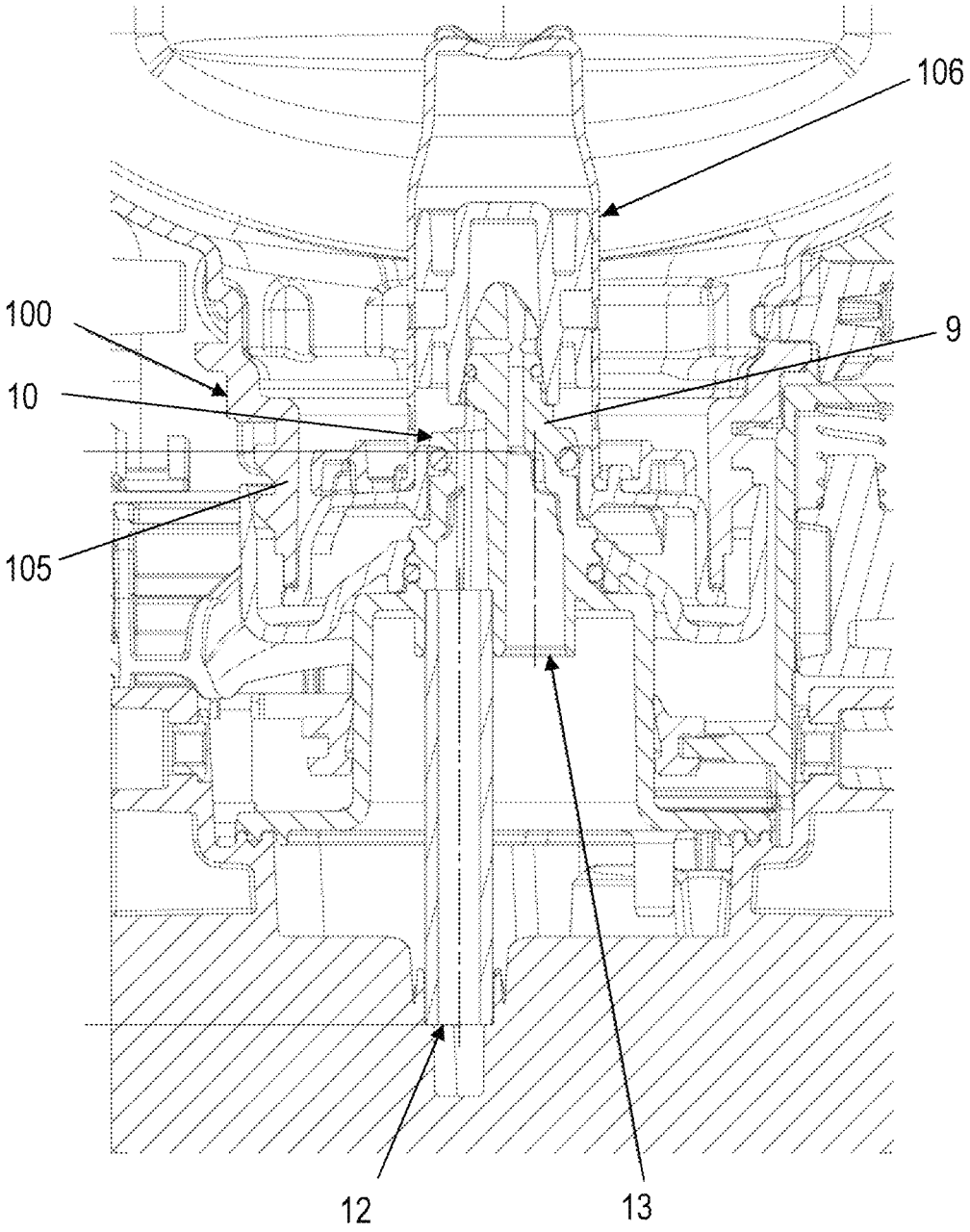
FIG. 4 shows a cross-section of a detail of the dispenser.

In FIG. 3 there is visible also an inlet connection 9 arranged on the bottom of the receiving space 5 for the connection to an outlet 105 of the container 100, which is depicted in greater detail in FIG. 4. The inlet connection 9 has a ram 10 that may extracted into the outlet 105 of the container 100 and that may be retracted from the outlet 105 of the container 100. The ram 10 is extracted when moving the container holder 3 into the operational position B. The ram 10 preferably extracts only immediately before reaching the operational position B, in particular within the last 20% of the movement path of the container holder 3 into the operational position B. Upon movement of the container holder into the replacement position A, the ram 10 is then retracted.

Slightly above the inlet connection 9, there are arranged two mutually slidable fixation elements 11, which are configured to be slid into engagement with the container 100 by moving the container holder 3 from the replacement position A into the operational position B and to be slid into disengagement with the container 100 by moving the container holder 3 from the operational position B into the replacement position A.

FIG. 4 shows a cross-section of a detail of the dispenser 1, wherein the inlet connection 9 and a container 100 in the coupling position with its outlet 105 mounted on the inlet connection 9 are visible. In the outlet 105 there is arranged a metering insert 106, which is opened by extracting the ram 10 into the outlet 105 or the metering insert 106, respectively, and which is closed by retracting the ram 10. In the opened state of the metering insert 106, the chemical agent 101 may flow through a path 12 for the chemical agent 101 and may be dispensed by the dispenser 1. There is further defined an air path 13, which enables in the opened state of the metering insert 106 the entry of air into the container interior.

FIG. 5 show a central longitudinal section through the dispenser 1. In this view, there are visible, among others, the device base 2, the container holder 3, the covering 4, the control 6, the sensor 7 for the contact-free detection of container information or container content information as well as the occupancy sensor 8. There is further visible the container 100 with the chemical agent 101 as content, an RFID label 102 that is symbolically indicated by means of an arrow, optional information 103 symbolically indicated by means of an arrow, wherein the RFID label 102 and the optical information 103 have stored or coded, respectively, container information or container content information, and the structural feature 104 of the container 100 in the form of a container shoulder, which has deflected the occupancy sensor 8, whereby the occupancy sensor 8 may recognize that the container 100 is in the coupling position in the container holder 3.

In the lower part of the dispenser 1 there is arranged a tank 21 for the temporary storage of the chemical agent 101. In this tank 21, the ram 10 is integrated in a liquid-tight and rigid way. The tank may then be moved together with the ram 10 by an actuator that is not depicted, such as, e.g., a mechanic setting, a solenoid or an electric motor, in the direction of the inlet connection 9 and away from there, whereby the ram 10 is extracted into the outlet 105 of the container when the container 100 is inserted and is then retracted therefrom. Protected against leaking in this way, the chemical agent 101 flows directly into the tank 21, with the ram 10 being extracted, where it is dispensed by way of gravity or by a pump installed within the dispenser that is not depicted.

Figure 6:
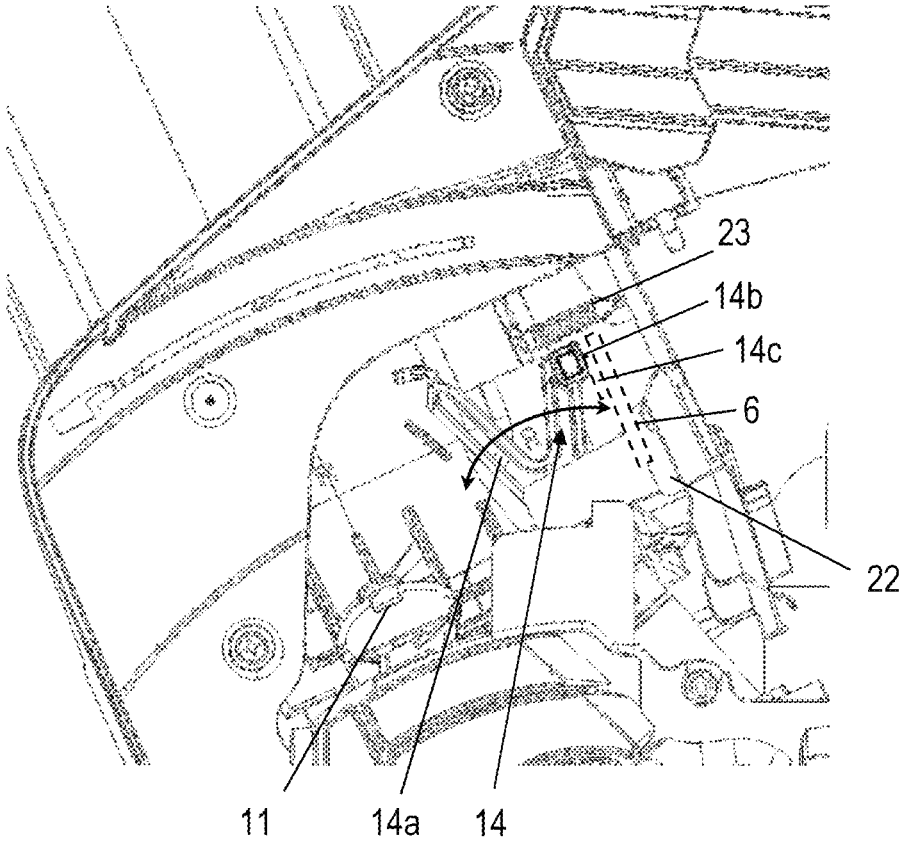
FIG. 6 shows a side view of a switch actuated by the occupancy sensor.

The occupancy sensor 8 acts on the switch 14 that is depicted in FIG. 6, biased by a spring 23 and embodied as a magnetic switch. The switch 14 comprises a pivotable (see double-arrow) deflection lever 14*a* actuated by the occupancy sensor 8, in which a permanent magnet 14*b* is installed. If the deflection lever 14 is in an activating position, then it is opposite to a Hall sensor 14*c* (or a Reed terminal) arranged within the tightly sealed printed circuit board housing 22, thus activating the Hall sensor 14*c* in a contact-free way. The Hall sensor 14*c* transmits the activation signal to the control 6 arranged within the printed circuit board housing 22, which activates the sensor 7 for the contact-free detection of container information or container content information. In the position depicted in FIG. 6, the switch 14 is in the activating position, i.e. the sensor 7 for the contact-free detection of container information or container content information has already been activated. By moving the container holder 3 into the operational position B, the pivoting lever 14*a* of the switch 14 is pivoted against the spring biasing direction into the deactivating position (in the depiction of FIG. 6 this is a pivoting movement towards the right), whereby the magnet 14*b* and the Hall sensor 14*c* are put out of active connection and thus the sensor 7 for the contact-free detection of container information or container content information is turned off by the control 6 in order to save energy and processor resources.

In order to enable the movement of the container holder 3 into the operational position B at all, the sensor 7 for the contact-free detection of container information or container content information has to have verified this information and it has to actuate an actuator 15 in the form of a solenoid, which switches a locking device 16 from a locking position into a releasing position. The locking device 16 has a latch that is not depicted, which abuts the housing stopper in the locking position.

FIG. 6 shows also one of the slidable fixation elements 11, which engage the container in the coupling position.

Figure 7:
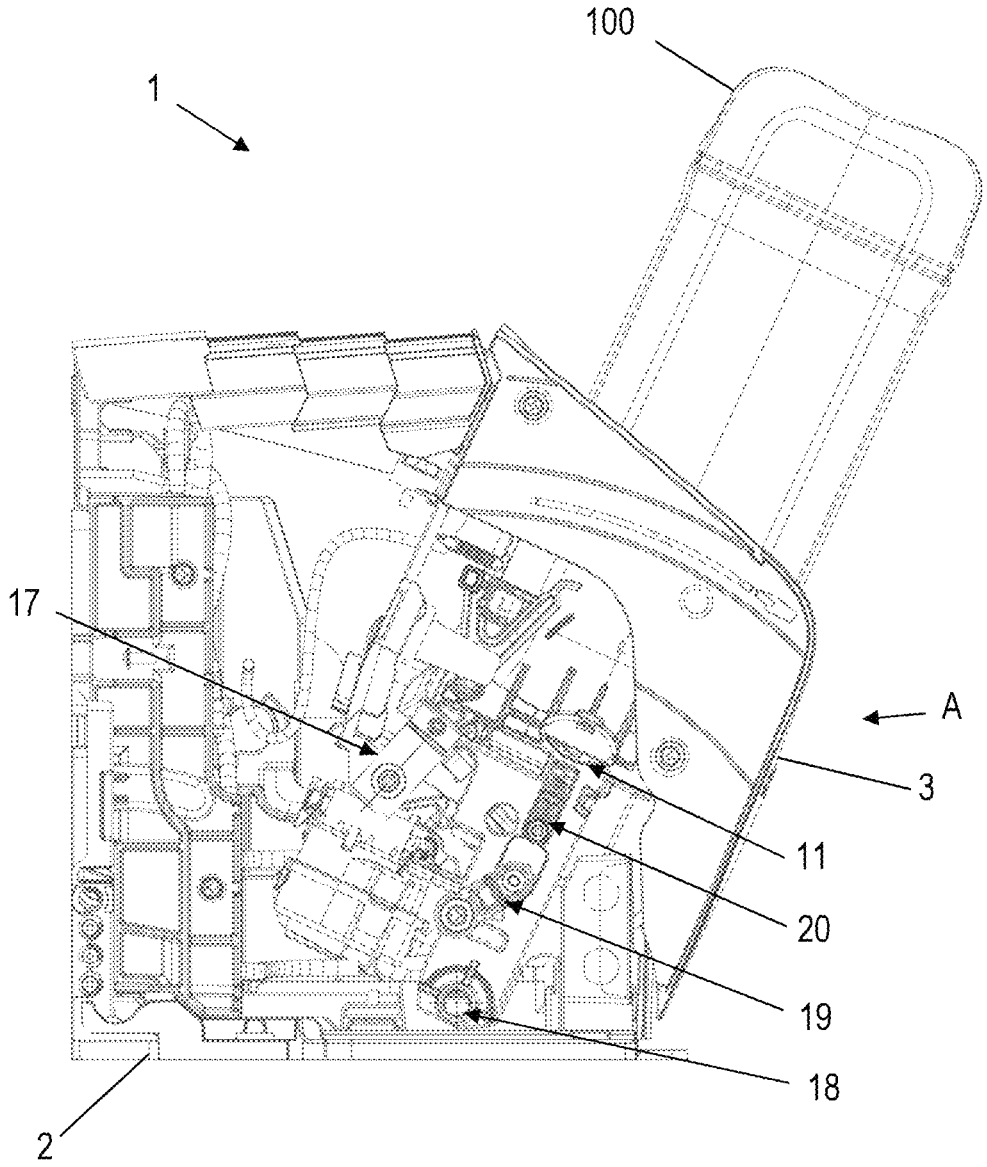
FIG. 7 shows a further longitudinal section through the dispenser.

In FIG. 7, the dispenser 1 is depicted in a further longitudinal section. There is, among others, visible a fixation element 11 and a spring 17, which is herein realized as a spring packet, which biases the container holder 3 into the end positions thereof, i.e. into the replacement position A and the operational position B. There is further illustrated the mechanism for guiding the container holder 3, which has a major rotational axis 18 and linear guiding elements 19. Pivoting notches 20 serve for the exact positioning and fixation of the container holder 3 in the replacement position A and the operational position B, by locking the container holder 3 in these end positions. In this way, the pivoting notches also act as a tactile indicator for the operator that the container holder 3 is in one of the two end positions.

The invention claimed is:

1. A dispenser for coupling with a container containing at least one chemical agent and for dispensing the chemical agent when the dispenser is coupled with the container, wherein the dispenser comprises a container holder, which has a receiving space, into which the container may be introduced at least in part into a coupling position, wherein the dispenser has a sensor arranged at or near the receiving space and configured for the contact-free detection of container information or container content information, wherein the dispenser has an occupancy sensor, which is configured to mechanically sense a container inserted into the receiving space and to detect whether the container is in the coupling position, and the sensor (for the contact-free detection of container information or container content information) is configured to detect the container information or the container content information and examine the correctness thereof, wherein the dispenser is configured to be released into an operational condition, wherein the chemical agent may be dispensed from the container only when the occupancy sensor has detected a container that has been inserted into the receiving space in the coupling position and when the sensor for the contact-free detection of container information or container content information has determined the correctness of the examined container information or container content information.

2. A dispenser according to claim 1, wherein the occupancy sensor is configured to activate, during the detection of a container that has been inserted into the receiving space in the coupling position, the sensor for the contact-free detection of container information or container content information, wherein the sensor for the contact-free detection of container information or container content information in the activated state detects the container information or container content information.

3. A dispenser according to claim 1, wherein the sensor for the contact-free detection of container information or container content information is configured to initiate the release of the dispenser into the operational condition, in which the chemical agent may be dispensed from the container.

4. A dispenser according to claim 1, wherein the sensor for the contact-free detection of container information or container content information is an RFID reader, which is configured to read an RFID label attached at the container.

5. A dispenser according to claim 1, wherein, characterized in that the sensor for the contact-free detection of container information is an optical sensor, which is configured to detect optical information attached at the container.

6. A dispenser according to claim 1, wherein the occupancy sensor is configured as sensor for mechanically scanning a structural feature of the container, optionally a shoulder, a projection or an indentation of the container.

7. A dispenser according to claim 1, wherein the receiving space is configured as a compartment.

8. A dispenser according to claim 1, wherein the container holder may be moved, optionally pivoted, between a replacement position (A), wherein a container may be inserted and retrieved, and an operation position (B), wherein the chemical agent may be dispensed from an inserted container, wherein there is provided a locking device that may be switched between a locking position and a releasing position and that is controlled by the sensor for the contact-free detection of container information, which only enables the movement of the container holder into the operational position (B) when it has been switched into the releasing position by the sensor for the contact-free detection of container information.

9. A dispenser according to claim 8, wherein the sensor for the contact-free detection of container information has an actuator, which is configured to switch the locking device between the locking position and the releasing position.

10. A dispenser according to claim 8, wherein the locking device has at least one extractable latch.

11. A dispenser according to claim 8, wherein the occupancy sensor is configured to deflect a switch into an activating position when the container is in the coupling position, wherein the switch in the activating position will activate the sensor for the contact-free detection of container information or container content information or will cause the control to activate, wherein the switch is configured to be deflected into a deactivating position by moving the container holder from the replacement position (A) into the operational position (B), wherein the sensor for the contact-free detection of container information or container content information is deactivated.

12. A dispenser according to claim 8, further comprising slidable fixation elements, which are configured to be slid into engagement with the container by moving the container holder from the replacement position (A) into the operational position (B) and to be slid out of engagement with the container by moving the container holder from the operational position (B) into the replacement position (A).

13. A dispenser according to claim 8, further comprising an inlet connection arranged within the receiving space for connection with an outlet of the container, wherein the inlet connection has a ram that may be extracted into the outlet of the container and retracted from the outlet of the container, wherein the ram is configured to extract upon movement of the container holder into the operational position (B).

14. A dispenser according to claim 13, wherein the ram is integrated in a tank for the temporary storage of the chemical agent and the tank is configured to move towards and away from the inlet connection, thus entraining the ram.

15. A dispenser according to claim 8, further comprising at last one spring, which biases the container holder into the replacement position (A) and the operational position (B).

16. A dispenser according to claim 8, further comprising pivoting notches, which lock the container holder in the replacement position (A) and in the operational position (B).

17. A dispenser according to claim 6, wherein the occupancy sensor is configured as a lever, a switch or a spring.

18. A dispenser according to claim 9, wherein the actuator is a solenoid.

19. A dispenser according to claim 11 wherein the switch is a magnetic switch.

20. A dispenser according to claim 13, wherein the ram extracts only immediately before reaching the operational position (B), optionally within the last 20% of the movement path of the container holder into the operational position (B), and to be retracted upon movement of the container holder into the replacement position (A).

* * * * *